US005082282A

United States Patent [19]

Hernberg

[11] Patent Number: 5,082,282

[45] Date of Patent: * Jan. 21, 1992

[54] DUAL LIGHT SOURCE GOLF SWING TRAINER

[76] Inventor: Joseph G. Hernberg, 514 Queen Anne Rd., Cherry Hill, N.J. 08003

[ * ] Notice: The portion of the term of this patent subsequent to Nov. 20, 2007 has been disclaimed.

[21] Appl. No.: 636,656

[22] Filed: Jan. 2, 1991

[51] Int. Cl.[5] ..... A63B 69/36

[52] U.S. Cl. ..... 273/186 A; 273/167 H

[58] Field of Search ..... 273/186 R, 186 A, 186 C, 273/186 AA, 186 B, 186 D, 30, 194 A, 183 D

[56] References Cited

U.S. PATENT DOCUMENTS

| | | | |
|---|---|---|---|
| 2,158,211 | 6/1938 | Aitken | 273/186 A |
| 3,070,373 | 12/1962 | Mathews | 273/186 A X |
| 3,649,028 | 3/1972 | Worrell | 273/186 A |
| 3,677,553 | 7/1972 | Moore | 273/186 A |
| 3,820,795 | 6/1974 | Taylor | 273/186 A |
| 3,953,034 | 4/1976 | Nelson | 273/186 C |
| 4,456,257 | 6/1984 | Perkins | 273/186 R |
| 4,911,450 | 3/1990 | Rabold | 273/186 A |
| 4,971,327 | 3/1990 | Rabold | 273/186 A |
| 4,971,328 | 11/1990 | Hernberg | 273/186 A |

*Primary Examiner*—George J. Marlo

*Attorney, Agent, or Firm*—Caesar, Rivise, Bernstein, Cohen & Pokotilow, Ltd.

[57] ABSTRACT

A golf club training device to be used by a person wherein the device simulates a conventional golf club. The device comprises a shaft having a longitudinal axis and a first and second end, a head secured to the first end of the shaft, and a grip means secured to the second end of the shaft for gripping the device. The head comprises a first light generating means for projecting a first beam of light out of the head, the first light generating means being oriented with respect to the head so that the first beam of light is projected out of the head towards a surface. The device also includes a second light generating means for producing a second beam of light in a direction opposite the head. The invention also includes a linear guiding indicia to be placed on the surface on which the golfer is standing to provide visual feedback regarding the golfer's swing.

12 Claims, 3 Drawing Sheets

FIG. 1
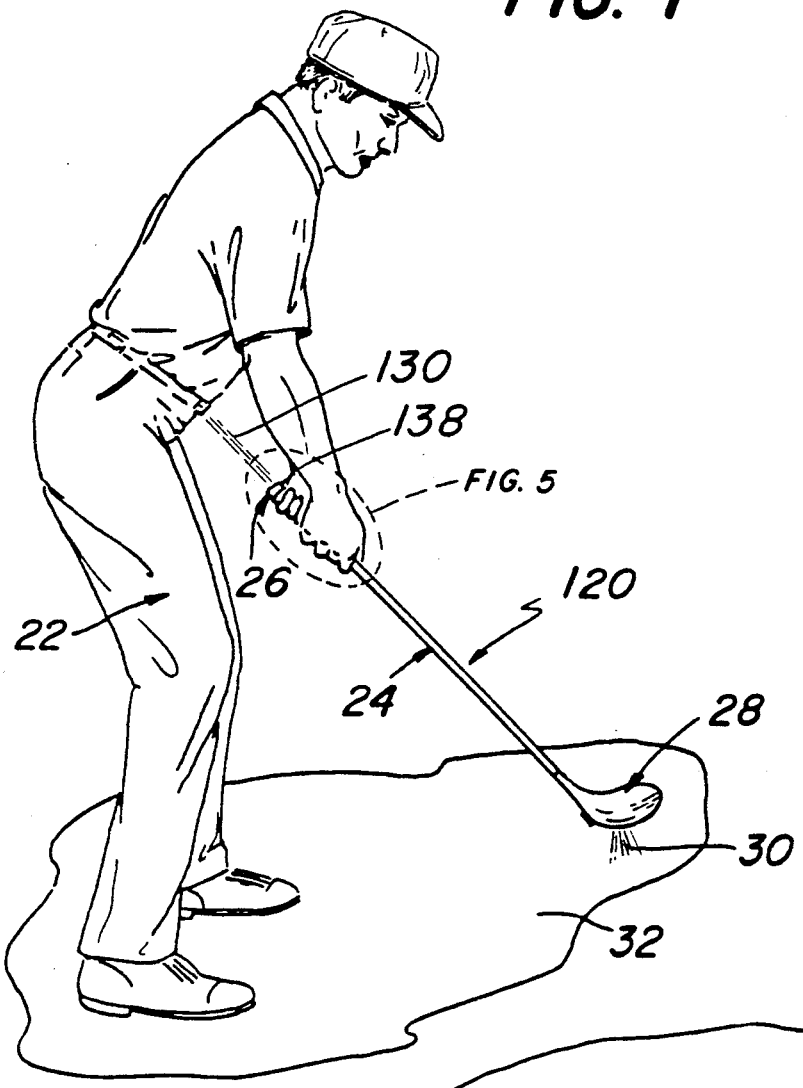
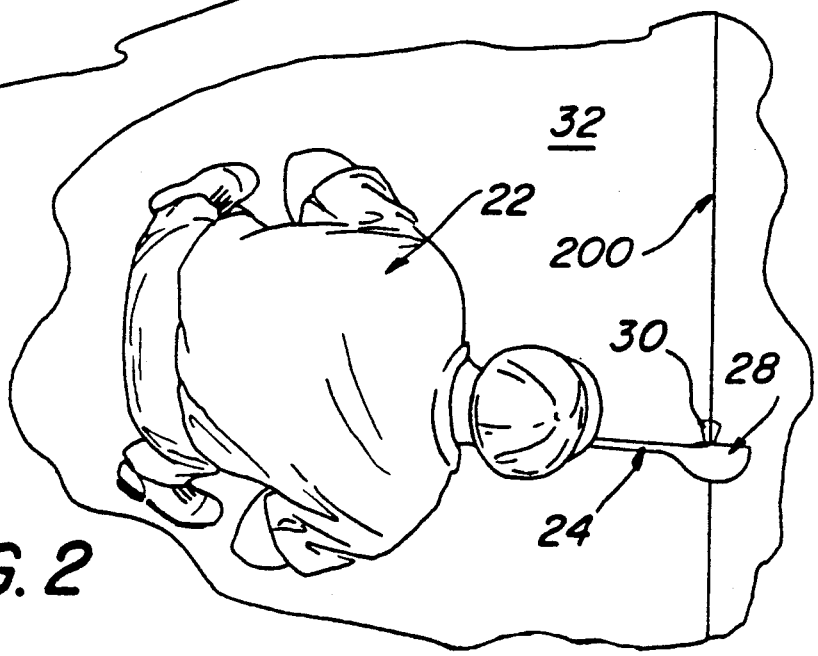
FIG. 2

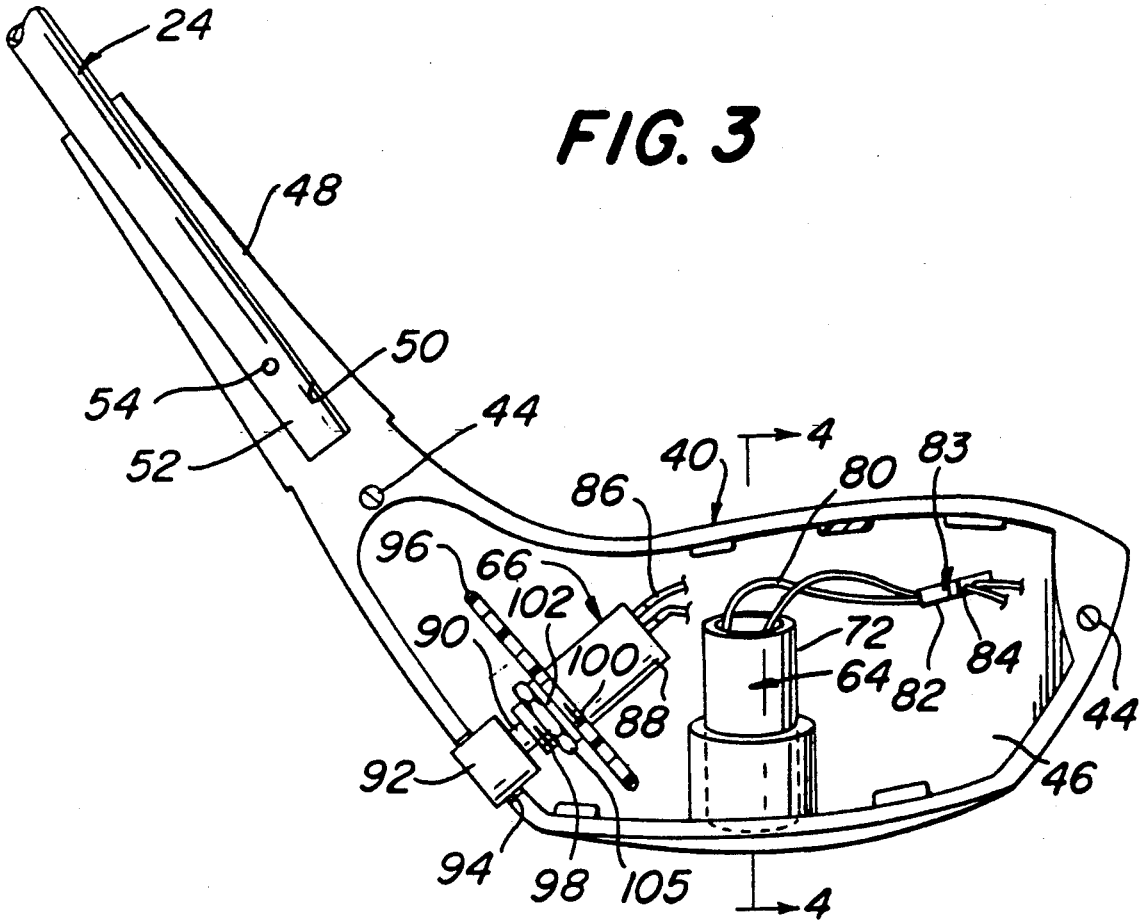
FIG. 3
FIG. 4
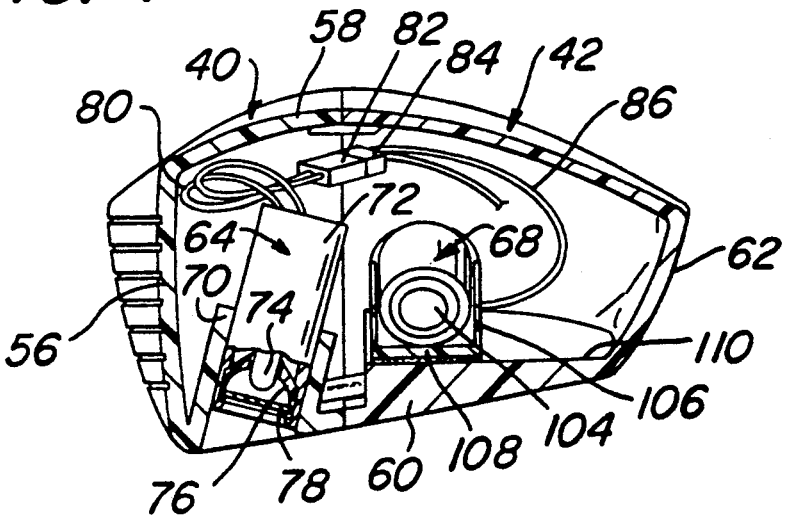

DUAL LIGHT SOURCE GOLF SWING TRAINER

RELATED APPLICATIONS

This application relates to an improvement in the golf swing training device which I disclosed and claimed in my U.S. Pat. No. 4,971,328, issued on Nov. 20, 1990, the entire disclosure of which is incorporated by reference herein.

BACKGROUND OF THE INVENTION

In my U.S. Pat. No. 4,971,328, I disclosed a golf swing training device in the configuration of a conventional club with a foreshortened shaft, which includes a light source only in the head to emit a beam of light to trace an arc of light across the ground as the club is swung to thereby provide a mental image to the golfer of the precise club path.

Prior art devices are designed to assist a golfer in improving the golfer's swing by providing visual assistance to trace and thereby examine his/her swing, to minimize or eliminate technique problems, such as hooking or slicing of the ball.

One such device, U.S. Pat. No. 3,070,373 issued to Donald K. Mathews et al, discloses an attachment to the club shaft. The attachment comprises a light source for projecting a collimated pencil beam of light downwardly onto the ground just ahead of the club and between the golfer and golf ball so that a visually perceived trace of club travel is given so that the golfer and/or instructor are informed of the golfer's swing. This device however, suffers from various drawbacks, such as aesthetics (due to the fact that the device is attached to the shaft), transportation difficulties (due to the fact that the device is powered by a large battery pack which rests on the ground near the golfer), etc.

The device disclosed in U.S. Pat. No. 3,953,034 issued to Rodney Nelson discloses a laser beam golf club training device which has a laser beam source attached to or mounted within the club shaft. The laser beam is reflected by a mirror attached to the club head to produce a fan of light to indicate the club head path. It is believed that the possibility of breakage of the convex mirror from which the laser beam must be reflected is a potential drawback to this device.

The device disclosed in U.S. Pat. No. 4,456,257 issued to Sonnie Perkins, discloses a golf swing training device which has a light source attached to the club shaft which emits two light beams lengthwise of the shaft to intersect the ground. The light source is wired to a battery pack which is clipped onto the golfer. The attachment of the light source to the shaft and the requirement that the golfer be wired to the device, thereby decreasing flexibility and increasing awkwardness, are believed to be potential disadvantages to this device.

In the training device disclosed in U.S. Pat. No. 2,158,211 issued to Matthew Aitken, the club head contains a light source and a pivoted battery support. The device is designed to permit a golfer to determine whether the golf club swing speed is proper. The two-piece shaft is enclosed at the joint by a flexible spring. When the club is swung at the correct speed, due to centrifugal force, the battery moves into engagement with the electrical contact and illuminates the electric bulb. Further, the shaft sections pivot with respect to one another due to angular acceleration imparted to the club by the golfer. This device also suffers from poor aesthetics and is believed to be much more complex than the instant invention.

U.S. Pat. No. 3,070,373 issued to Mathews et al. discloses a visual swing indicator which is attached to the shaft of a standard golf club near the club head and comprises a light source projecting a narrow or collimated beam of light downwardly from the club to trace the light beam the ground to show the movement of the club head.

Other golf training devices include generally those disclosed in U.S. Pat. No. 3,677,553 issued to Eric Moore and U.S. Pat. No. 3,820,795 issued to David Taylor, which disclose golf club heads with lights indicating a golfer's swing, the latter further disclosing a battery for the light mounted within the golf club shaft.

The use of ultraviolet light and luminescent strips on a golf club head or chemical light on a golf club head are disclosed in U.S. Pat. No. 3,649,028 issued to Eugene Worrell.

OBJECTS OF THE INVENTION

It is a general object of this invention to provide a golf training device enabling a golfer to visualize the golf club path to correct deficiencies in the golfer's swing.

It is a further object of the invention to provide a golf swing training device which is aesthetically pleasing and simulates the appearance of an actual golf club.

It is also a further object of the invention to provide a golf swing training device which is low in cost, simple in construction and easily transportable.

It is a further object of this invention to provide a golf swing training device with multiple light sources to assist in training a golfer.

It is yet another object of the invention to provide a golf swing training device having one light source in the head and a second light source in the club grip to assist in training a golfer.

SUMMARY OF THE INVENTION

These and other objects of this invention are achieved by providing a golf swing training device which permits a golfer to examine and critique his/her golf club swing and its deviations from the desired swing.

In accordance with a broad aspect of this invention, the device simulates a conventional golf club and comprises a shaft having a longitudinal axis and a first and second end, a head secured to the first end of the shaft, and a grip means secured to the second end of the shaft for gripping the device. The head comprises a first light generating means for projecting a first beam of light out of the head. The first light generating means being oriented with respect to the head so that the first beam of light is projected out of the head towards a surface. In addition, the device comprises a second light generating means for producing a second beam of light in a direction opposite the head.

Also in a preferred embodiment of this invention, the second light generating means is attached to the grip having a hollow interior for retaining the second light generating means, so that it directs the second light beam in a direction coincident with the longitudinal axis of the shaft.

In accordance with the most preferred embodiment of the device, the head comprises a hollow body which contains a self-contained electrical power source means, the first light generating means for projecting a first beam of light out of the head and switch means for causing the light generating means to produce the beam of light from the electrical power source means. The first light generating means is oriented so that the beam of light is projected out of the head towards the surface and slightly forward of the head, whereupon when the person swings the club, the person can freely see the beam of light projected in a path across the surface.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is a side view of a golfer holding the improved golf swing training of the above invention;

FIG. 2 is a top view of a golfer holding the golf swing training device of the above invention while utilizing the swing guide marker;

FIG. 3 is an enlarged side elevational view, of one portion of the head of the golf swing training device of the present invention;

FIG. 4 is an enlarged sectional view taken along lines 4—4 of FIG. 2.

DETAILED DESCRIPTION OF THE PREFERRED EMBODIMENTS

Figure 5:
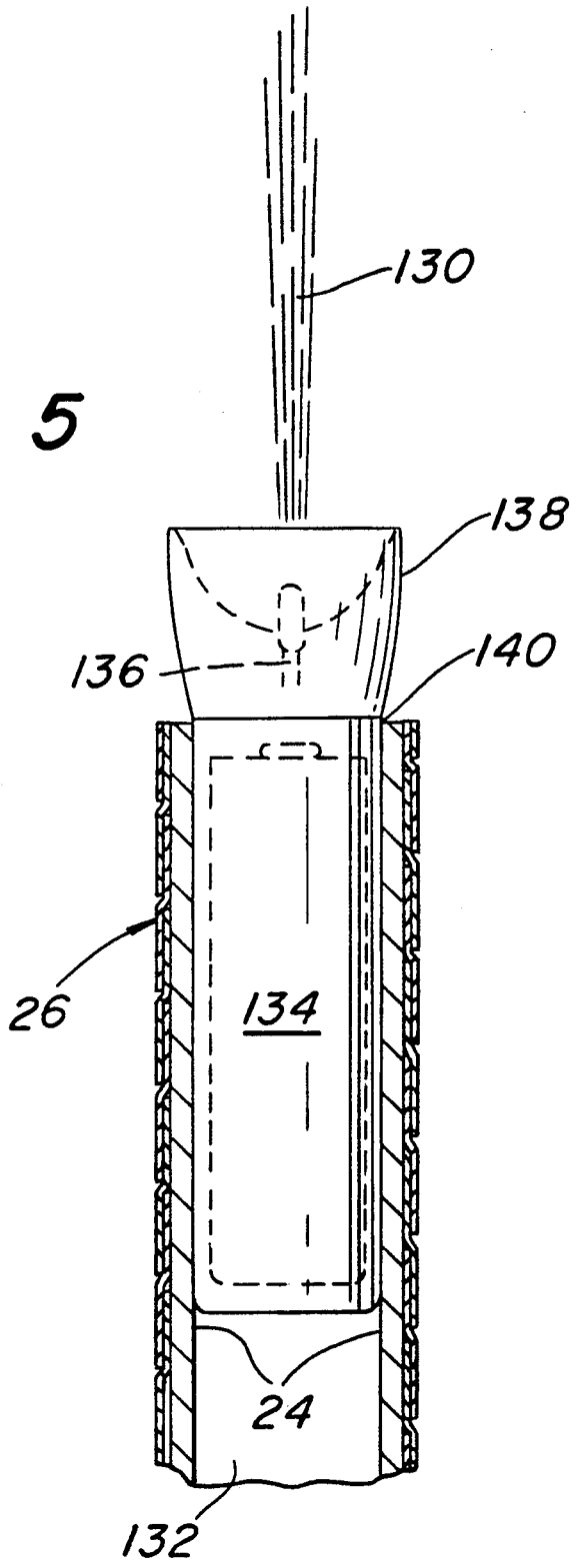
FIG. 5 is an enlarged sectional view of the improved golf swing training device in the region 5 of FIG. 1.

Referring now to the various figures of the drawing wherein like reference numerals refer to like parts there is shown at 120 in FIG. 1 the improved golf swing training device constructed in accordance with this invention and being used by a golfer 22 to practice his swing.

The golf training device 120 basically comprises elongated shaft 24 having a conventional grip 26 at its upper end and a head 28 located at its lower end. The head 28, as previously disclosed and claimed in my prior '328 patent, identified earlier, will be described in considerable detail later. Suffice it for now to state that it includes means for projecting a beam of light 30 out of the bottom thereof and slightly forward of the front face of the club (to be described later). In the preferred embodiment, as shown more clearly in FIG. 5, a second light generating source 140 is preferably secured in the tube 132 of the club shaft 36 to produce a beam of light 130, opposite the club head 28, as described in further detail below.

As shown in FIG. 1, in use, the golfer 22 swings the device 120 in a conventional manner over the ground or some other surface 32 so that the golfer can see the path of the first light beam 30 produced by the club head 28 across the ground 32. This enables the golfer to "groove" his/her swing. In addition, the golfer 22, can see the second light beam 130 which preferably produces a full circle of light (not shown), as the golfer swings the device 120, to provide additional feedback on his/her swing.

As shown in FIG. 2, in accordance with a preferred embodiment of the invention an indictor strip 200 is arranged to be disposed on the ground to provide a club-head trajectory line. That strip can take many forms, such as a strip of plastic. For indoor use, the strip may be arranged to be fixedly secured in place on to the floor or carpeting via the use of VELCRO or some other material, e.g., double sided tape, etc. to prevent it from slipping. Thus, the guide strip 200 provides the golfer with a guide by which he/she may observe and provide the path of the light beam projecting from the club head to the desired path, (as established by the strip) a he/she swings the club in a conventional manner.

As shown in FIG. 1 in accordance with a preferred aspect of this invention, the golf shaft 24 is foreshortened by approximately eight inches from the standard shaft length to expedite the use of the device. In the preferred embodiment, the shaft has a length of approximately 34 inches (86.36 cm). In this connection, the shortened shaft permits the first light beam 30 exiting from the club head 28 (which will be described later in detail) to be readily seen by the user 22 as he/she practices his/her swing. Moreover, golfers may want to practice their golf swing in areas which are too confined for use of a full-length club. Thus, the foreshortened shaft 24 also serves the advantage of minimizing the possibility of damage to furniture or other articles in the areas surrounding the area where the device is used for practice.

The shaft 24 is composed of any suitable rigid, somewhat resilient material. However, in the preferred embodiment the shaft is constructed from a light weight aluminum or steel. The grip 26, which is located at the top of the shaft, is fixedly secured thereto in any conventional manner, e.g., adhesive. The grip 26 is preferably comprised of any suitable material to enable the golfer to maintain a firm, comfortable grip on the device. Thus, any conventional grip material can be used.

Before discussing the construction of the club head 28 it should be noted that in the embodiments shown herein the head is in the form of a typical "wood" type head. Such a construction is preferred inasmuch such a head provides the most interior space (as compared to a "iron" head) for the components producing the light beam 30. However, it is contemplated that other style heads can be utilized in lieu of the wood-style head shown and described herein.

Turning now to FIGS. 3 and 4, the details of the head 28 will now be considered.

The club head 28 basically comprises two sections 40 and 42. The sections ar preferably molded of a high impact plastic and each is hollow. The two sections are assembled together via screws 44 to create a hollow interior cavity 46 for the electrical components of the device. The section 40 constitutes the front section of the head 28, while the section 42 constitutes the club head rear section. The front section 40 and the rear section 42 each include a neck portion 48 projecting upwardly therefrom. The neck portions when joined together form a hollow bore 50 into which the lower end 52 of the shaft 24 is secured, via at least one screw 54. In addition, an adhesive (not shown) may be used to aid in the securement of the shaft to the club head neck.

When the two sections 40 and 42 are secured together they form the heretofore identified club head 28. As can be seen in FIG. 4, that club head includes a front wall portion 56, a top wall portion 58, a bottom wall portion 60, and a rear wall portion 62. The front wall portion 56 has the outer surface appearance of a conventional ball impacting surface of a club. To that end it includes parallel grooves in its surface.

The means for producing the first light beam 30 basically constitutes a lamp assembly 64, an on/off switch assembly 66, and a power source 68. The lamp assembly 64 is mounted within a tubular well 70 which projects upward at an acute angle from the bottom surface of the bottom wall 60 of the club head 28. The well is open at its bottom to form the outlet through which the light beam 30 projects.

The lamp assembly 64 basically comprises a cylindrical housing 72 in which is located a conventional lamp or bulb 74. In a preferred embodiment of the invention the bulb is preferably a one watt krypton bulb. Preferably, the lamp utilized produces a diffuse beam of light to form a cone of light which is more easily perceived. However, it should be readily apparent to those skilled in the art that other types of beams may be produced, e.g., collimated, etc., by substitution of the bulb for another type. Disposed about the front of the bulb is a conical reflector element 76. The reflector element is held in place in the front portion of the lamp assembly housing 72. A transparent lens 78 is disposed immediately adjacent the bulb 74 and the reflector 76 within the lamp assembly housing front (lower) end. Thus, when the lamp assembly 64 is disposed within the well, the lamp faces downward so that its light passes through the lens out the opening at the bottom of the well to be directed downwardly and forwardly of the front surface 56 of the club head.

The lamp assembly 64 may be held in place either by a fictional fit or by some other releasable securement means (not shown) so that the assembly can be removed, if desired, for servicing or replacing. A conventional pair of wires 80, extend from the lamp assembly. These wires terminate in one portion 82 of a connector 83. The other portion 84 of the connector is connected to other wires 86 which are connected in series with the switch assembly 66 and the power source 68, as is conventional.

The switch assembly 66 basically comprises a switch body 88 in which the switch components are mounted. The actuator of the switch is denoted by the reference numeral 90 and includes at its free end an enlarged head or push button 92. That head or push bottom extends through an opening 94 in the club head adjacent the neck portion 48. The switch 66 is fixedly mounted within the club head cavity 46 via a mounting wall 96 which is formed integrally with the front head section 40. The switch assembly includes a threaded neck 98 which extends through a hole 100 in the mounting wall 96, a lock washer 102, and lock nut 105 are provided on the threaded neck 98 of the switch to secure it to the wall 96.

The power source 66 is best seen in FIG. 4 and basically comprises a conventional battery, such as a "C-type" 1.5 volt cell. The battery or cell 104 is disposed within a carrier or holder 106.

The holder is fixedly secured via an adhesive layer 108 to the inner surface 110 of the bottom wall 60 of the club head. The battery holder 106 includes a pair of terminals (not shown) to which the heretofore identified wires are connected so that the battery is connected in series with the switch 66 and lamp 74. Thus, one of the terminals is arranged to be engaged by the anode of the battery 104 when the battery is located within the holder 106 while the other terminal is arranged to be engaged by the cathode of the battery.

The switch 66 is arranged such that when its push button 92 is depressed it closes, whereupon electric current is provided to the lamp 74 to energize it and thereby produce the downwardly and forwardly extending first light beam 30. After use, the push button 90 may again be depressed, whereby the switch opens so that the bulb is no longer illuminated, thereby conserving battery power.

As should be appreciated from the foregoing, the training device 120 of the subject invention is simple in construction, can be manufactured at a relatively low cost, can be used either indoors or outdoors in relatively confined areas, yet provides an excellent method of enabling a golfer to "groove his/her swing" by watching the path of the first moving beam of light 30 across the ground or the marker indicia 200.

The club head 28 is aesthetically pleasing in that it resembles a conventional head, yet, contains the light source, power source and switch, so that none is readily visible. This feature further contributes to the aesthetically pleasing appearance of the device. Moreover, the fact that all the components are contained within the club head renders it readily transportable, easy to use, and less likely that the components are damaged during storage and/or transport.

By virtue of the fact that the club head 28 is formed in two sections which ar releasably secured together via the screws 44, easy access to the interior of the head is provided for servicing or replacement of any of the components. Thus, for example if the lamp assembly malfunctions, all that is necessary for repair is to disconnect the connector sections 82 and 84, remove the lamp assembly 64 from the well 70 and replace it with another lamp assembly or with the old lamp assembly having a new bulb in it. Replacement of the battery is easily effected by merely snapping it out of its holder. The switch 90 can be readily replaced by unfastening the locking nut and removing the switch from the mounting wall 98.

As shown at 120 in FIGS. 1 and 5, the details of the second light source 140 of the improved golf swing training device of the instant invention will be described. To that end, in the preferred embodiment of the device 120, the club grip 26 additionally comprises a second light generating source 140 which projects a second light beam 130 out of the grip 26 in a direction opposite the club head 28. Although in the most preferred embodiment, the second light source 140 is shown contained within the grip 26, it should be readily apparent to those skilled in the art that the second light source 140 may be attached to the club shaft 24 or grip 26 in any way or position and that the invention is not so limited to the embodiment shown herein. To that end, the second light source may be attached to the shaft 24 anywhere along its length.

In the most preferred embodiment as shown in FIG. 1, the second light source 140 produces a second light beam 130 in a direction coincident with the longitudinal axis of the shaft 24 and is preferably concentrated as described below.

As shown more clearly in FIG. 5, the second light generating source 140, is preferably of a conventional design, and may comprise, for example, a typical miniaturized flashlight which is frictionally secured in the tube or channel 132 of the club shaft 24. Preferably the source 140 can be removed to replace any of its components such as the battery 134, light bulb 136, reflective crown element 138, etc. The second light source 140 may also be secured in any fashion, and may be secured to protrude out of the channel 132 as desired. In order to aid in repair, and activation (if necessary), it is preferable that the light source 140 be removable whereupon it may be activated by depressing a switch (not shown) to turn the power off/on. Other typical flashlights which may be utilized with the present invention, permit the light source to be activated by depressing and turning the crown 138 of the light source 140, so that the terminals (not shown) contact the battery 134 providing a power source, thereby eliminating the necessity of removing the light source 140 from the channel 132 each time the device is activated/deactivated.

In the preferred embodiment, the second light beam 130 is concentrated or collimated, to produce a full circle of light (not shown) as the device 120 is swung in a conventional fashion and the light beam 130 projects coincident with the longitudinal axis of the shaft 24, as shown in FIG. 1. This full circle of light provides the golfer 22 with greater visual feedback on his or her swing, in addition to the visual feedback simultaneously produced by the light beam 30 in the club head 28. Since the second light beam 130 is activated independently of the first light beam 30, the golfer may choose to utilize both light sources simultaneously, or either one alone, depending upon the circumstances of use.

Without further elaboration the foregoing will so fully illustrate my invention that others may, by applying current or future knowledge, readily adapt the same for use under various conditions of service.

I claim:

1. A golf club training device to be used by a person wherein the device comprises a shaft, and a head simulating the appearance of a conventional golf club, said head having a front face, said shaft having a longitudinal axis and being foreshortened so that when said device is swung to simulate the driving of a golf ball, said head is spaced slightly off of the surface upon which said person using said device is standing, said head comprising a hollow body containing self-contained electrical power source means, first light generating means and switch means, and wherein said first light generating means is arranged for projecting a first light beam out of said head, said switch means being connected to said first light generating means and said power source means for causing said first light generating means to produce said first light beam from said electrical power source means, said first light generating means being oriented with respect to said hollow body so that said first light beam is projected out of said head toward said surface and slightly forward of said front surface of said head, whereupon when said person swings said golf club training device, said person can freely see said first light beam projecting in a path across said surface to enable said person to adjust said swing to a desired path, said device additionally comprising second light generating means being arranged for projecting a second light beam in a direction opposite the head.

2. The device of claim 1 wherein said second light beam is projected in a direction coincident the longitudinal axis of the shaft.

3. The device of claim 1 wherein said device additionally comprises a grip, wherein said grip additionally comprises said second light generating means.

4. The device of claim 1 wherein said second light beam is concentrated.

5. The device of claim 1 wherein said power source means comprises a battery.

6. The device of claim 1 wherein said first light generating means comprises a bulb.

7. The device of claim 6 wherein said bulb comprises a krypton bulb.

8. The device of claim 1 wherein said head comprises a first section releasably secured to a second section.

9. The device of claim 1 further comprising a guiding indicia means to be located on said surface directly in front of said person.

10. The device of claim 9 wherein said guiding indicia means comprises a linear strip and means for mounting said linear strip to said surface.

11. The device of claim 1 wherein said second light generating means is removably secured to said club.

12. The device of claim 1 wherein said second light generating means comprises a bulb.

* * * * *